US005368156A

United States Patent [19]

Bruzzi et al.

[11] Patent Number: 5,368,156

[45] Date of Patent: Nov. 29, 1994

[54] PALLET ASSEMBLY WITH CONTAINER THEREON

[75] Inventors: Mark T. Bruzzi, Coudersport, Pa.; Peter C. Sherer, Rochester, N.Y.

[73] Assignee: Eastman Kodak Company, Rochester, N.Y.

[21] Appl. No.: 7,642

[22] Filed: Jan. 21, 1993

[51] Int. Cl.[5] ..... B65D 75/00

[52] U.S. Cl. ..... 206/203; 206/386; 206/564; 206/821; 220/23.83; 220/516

[58] Field of Search ..... 206/203, 386, 519, 520, 206/562, 563, 564, 821; 220/23.83, 23.86, 513, 516, 519; 108/55.3

[56] References Cited

U.S. PATENT DOCUMENTS

| | | | |
|---|---|---|---|
| 2,444,326 | 6/1948 | Baker et al. | 248/120 |
| 2,619,251 | 11/1952 | Schmidt | 220/513 |
| 3,337,081 | 8/1967 | Earp | 220/516 |
| 3,390,801 | 7/1968 | Adomat | 220/516 |
| 3,921,540 | 11/1975 | Meinick et al. | 108/55 R |
| 3,948,190 | 4/1976 | Cook, III et al. | 108/53 |
| 3,993,168 | 11/1976 | Kubick | 108/53.1 |
| 4,667,837 | 5/1987 | Vitello et al. | 206/564 |
| 4,684,013 | 8/1987 | Jacobs | 206/564 |
| 4,700,837 | 10/1987 | Hammett | 220/516 |
| 4,722,440 | 2/1988 | Johnston | 206/319 |
| 4,735,321 | 4/1988 | Day | 206/597 |
| 4,778,056 | 10/1988 | Faulstick et al. | 206/564 |
| 4,782,763 | 11/1988 | Salloum | 108/55.3 |
| 4,887,537 | 12/1989 | Kellogg | 108/55.1 |
| 5,038,961 | 8/1991 | Watanabe et al. | 220/516 |
| 5,115,937 | 5/1992 | Chausse et al. | 220/519 |

*Primary Examiner*—David T. Fidei
*Attorney, Agent, or Firm*—Clyde E. Bailey

[57] ABSTRACT

A pallet assembly 10 with a select container 16, 18, 20, or 22 thereon comprises a body member 11 having a rear face 12 and front face 14, and sidewalls 48 supportably surrounding the rear and front faces 12, 14. In an alternative embodiment, a face plate 27 having a plurality of contoured openings 32 is affixed to rear face 12. Rear face 12 has at least one cavity 24 and a base 26 extending upwardly into cavity 24 defining a container receptacle 28. Front face 14 has at least one cavity 30 having a base 34 extending inwardly of cavity 30 and means cooperatively associated with the cavity 30 for defining a container receptacle 36 in front face 14. In practice, either the front face 14 or rear face 14 can be used to transport and store thereon a select container 16, 18, 20. 22.

17 Claims, 7 Drawing Sheets

FIG.6
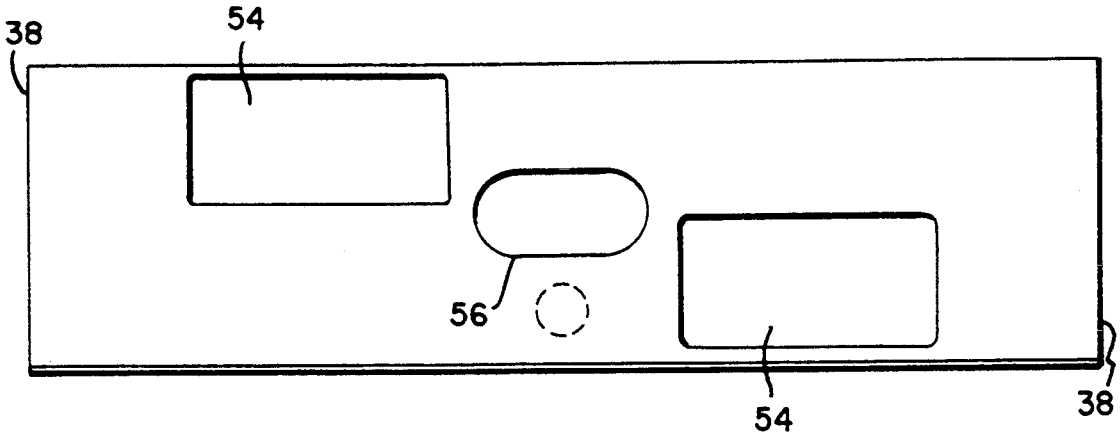
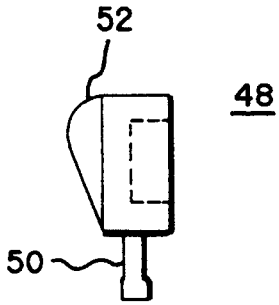
FIG.9
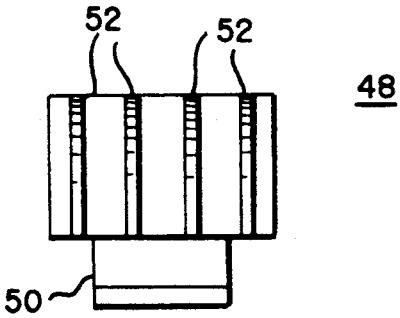
FIG.10

PALLET ASSEMBLY WITH CONTAINER THEREON

FIELD OF THE INVENTION

The invention relates to a pallet assembly with a container thereon, and more particularly, to a container and pallet assembly in which the pallet supports the container during handling.

BACKGROUND OF THE INVENTION

Typically, objects such as containers, are routinely oriented, positioned, transported and stored in trays or pallets. However, where the container, such as a solution container, does not have stable dimensions, i.e., the dimensions shifts or changes with the movement of the solution contained therein, handling of the solution container in a pallet assembly becomes unwieldy. The handling problem is particularly acute when the container is to be stored and transported in automated handling equipment. In an automatic handling system, solution containers inserted into pallets are conveyed, turned, diverted, stopped, started, lifted and lowered. All of these movements would serve to tip the solution container if it does not fit snugly into the pallet.

One such attempt to solve the aforementioned problem is disclosed in U.S. Pat. No. 2,444,326 by Baker et. al. in which articles such as cans, buckets and drums are stored securely on a platform with a plurality of hold down straps consisting of an elongated flat strip having a key hole keeper slot formed in its upper end and having a integral threaded rod formed in its lower end. However, the shortcoming of this arrangement is that unstable containers, such as plastic bottles and the like, would not fit securely in the platform during automated handling. Moreover, other shortcomings of the prior art teaching of Baker are that it only restricts lateral movement or sliding of the articles contained thereon and relies only on gravity (container weight) to prevent accidental tipping.

SUMMARY OF THE INVENTION

It is, therefore, the object of the invention to overcome the shortcomings of the prior art. Accordingly, the aforementioned problem can be solved by providing a pallet assembly for transporting and storing one of a select sized container, the pallet assembly comprising:

a body member having a first face and a second face;

the first face having at least one cavity defining a first container receptacle, the first container receptacle having a base extending upwardly into the cavity;

the second face having at least one cavity and means cooperatively associated with the cavity on at least one side of the cavity defining a second container receptacle and wherein the base extending upwardly into the first container receptacle extends inwardly of the second container receptacle;

whereby the first container receptacle or the second container receptacle can be used to transport and store one of a select container.

BRIEF DESCRIPTION OF THE DRAWINGS

The foregoing as well as other objects, features and advantages of this invention will become more apparent from the appended Figures, wherein like reference numerals denote like elements, and wherein:

FIG. 6 is a side elevation view of the pallet;

FIG. 9 is a side elevation view of the insert; and,

FIG. 10 is a front elevation view of the insert.

DETAILED DESCRIPTION OF THE INVENTION

Figure 1:
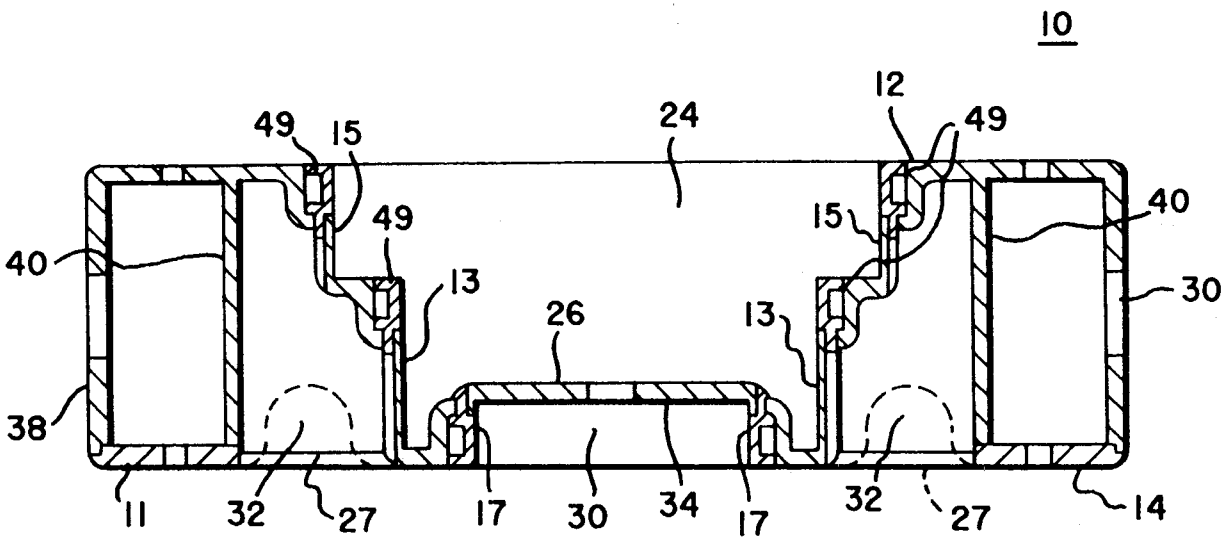
FIG. 1 is a cross sectional view of the pallet system of the invention.
Figure 2:
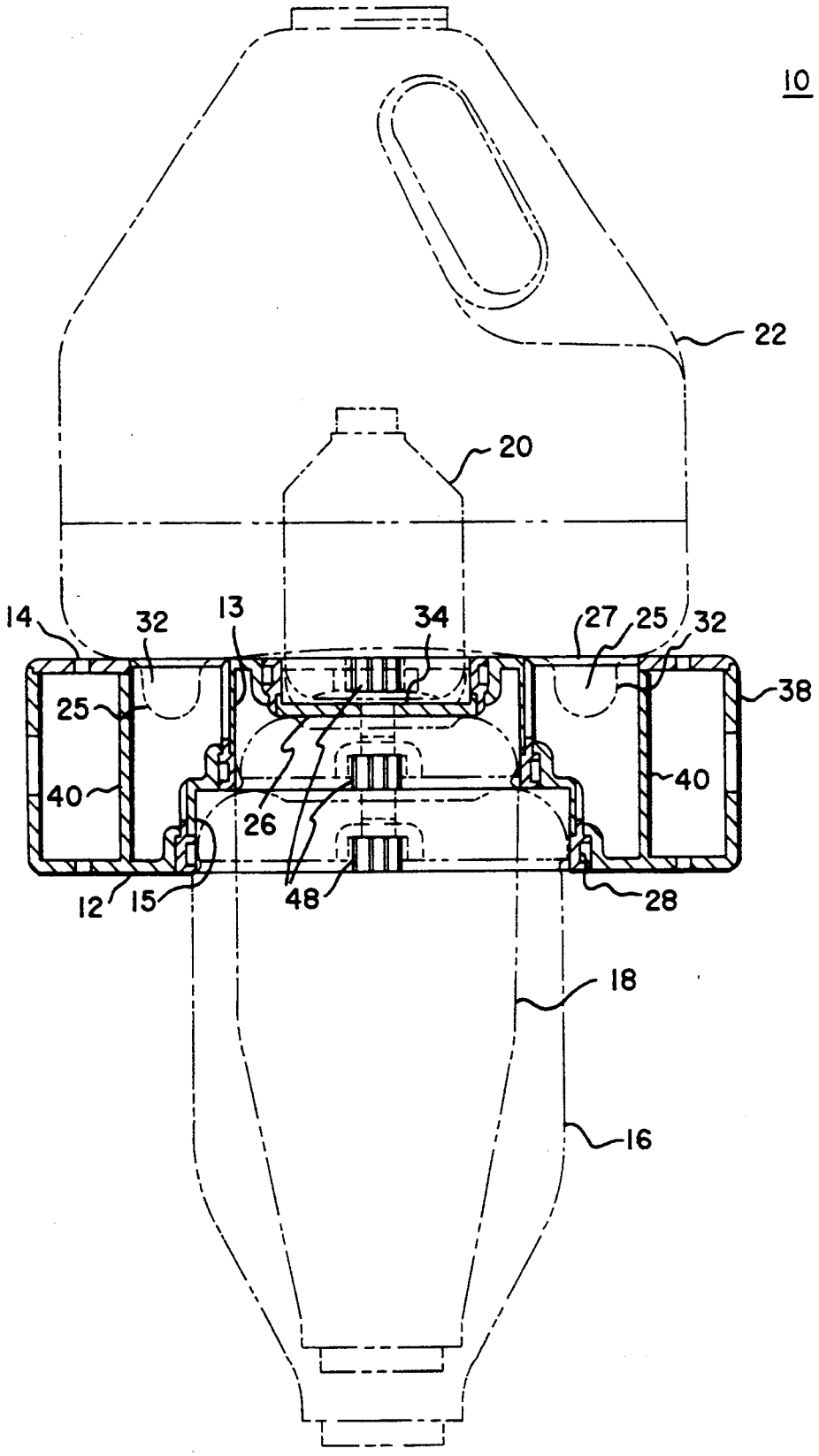
FIG. 2 is a cross sectional view of the pallet system having thereon alternative arrangement of select sized containers.
Figure 3:
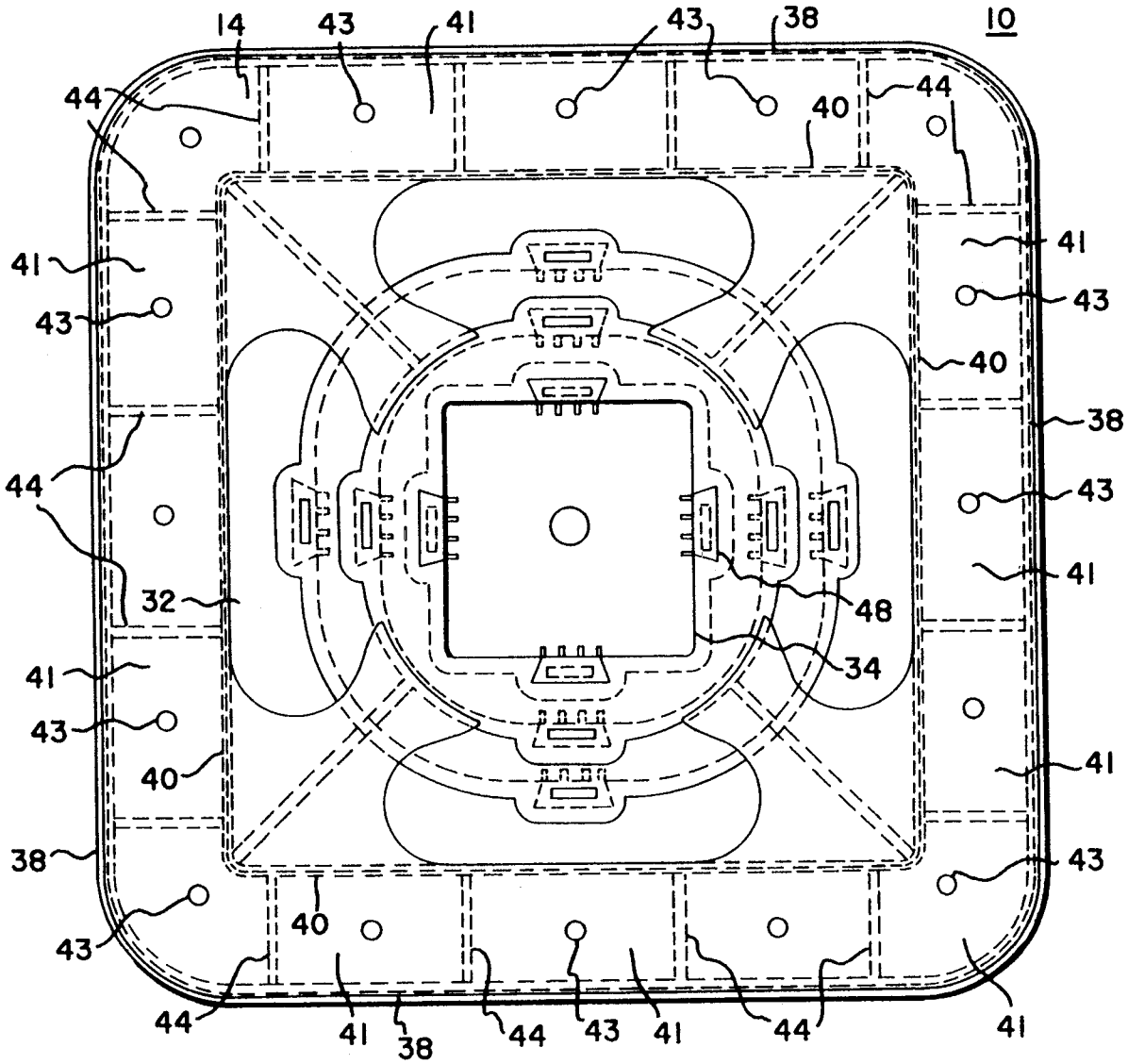
FIG. 3 is a top plan view of the pallet of the invention showing the front face.
Figure 4:
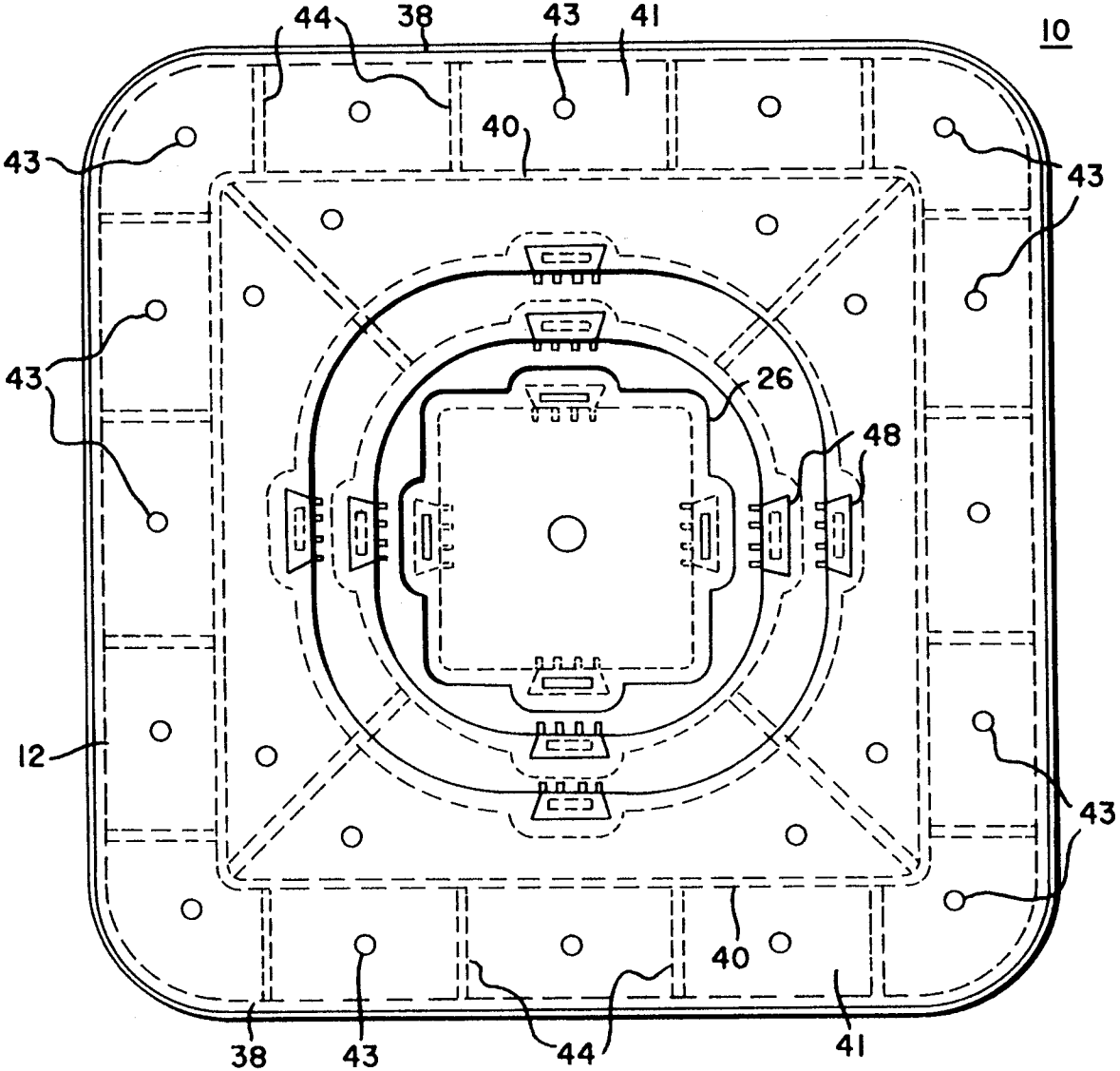
FIG. 4 is a bottom plan view of the pallet of the invention showing the rear face.

Turning now to the drawings, and more particularly to FIGS. 1–4, there is shown pallet assembly 10 of the invention having a body member 11. Body member 11, preferably having a substantially parallepiped shape, comprises rear face 12 and front face 14 (shown clearly in FIGS. 3 and 4, respectively) for capturing thereon one of a select sized container 16, 18, 20, or 22. Rear face 12 (as best seen in FIGS. 1,2 & 4) has at least one cavity 24 therein defined by a plurality of substantially concentric upstanding interior walls 13,15 and a common base 26 extending upwardly into cavity 24. Thus, in this embodiment, cavity 24, sidewalls 13,15 and common base 26 cooperate to define a container receptacle adapted to receive one of a select sized container 16 or 18. Front face 14 (as best seen in FIGS. 1,2 & 3) has at least one central cavity 30 having interior walls 17, at least one contoured opening 32 defined by face plate 27 (described in more details below) on at least one side of cavity 30, and a base 34 formed by the inward extension of base 26 (described above) into central cavity 30. Accordingly, central cavity 30, base 34 and contoured opening 32 cooperate to define container receptacle adapted to receive one of a select sized container 20,22 in front face 14.

In the preferred embodiment, body member 11 comprises upstanding outer sidewalls 38 (FIGS. 1–4) having substantially parallel inner wall member 40 surroundingly supporting rear face 12 and front face 14 of pallet 10. Inner and outer wall members 38,40 are interconnected by a plurality of support members 44 or webs that provides structural strength for pallet 10. Moreover, support members 44, while thin enough for injection molding, provide structural integrity for select sized containers 16, 18, 20, or 22 thereon. Support members 44 form a series of pockets 41 (FIGS. 3 & 4) in sidewalls 38 each of which has at least one drain hole 43. Drain holes 43 allow water which settles on pallet system 10 after washing to drain off.

Figure 5:
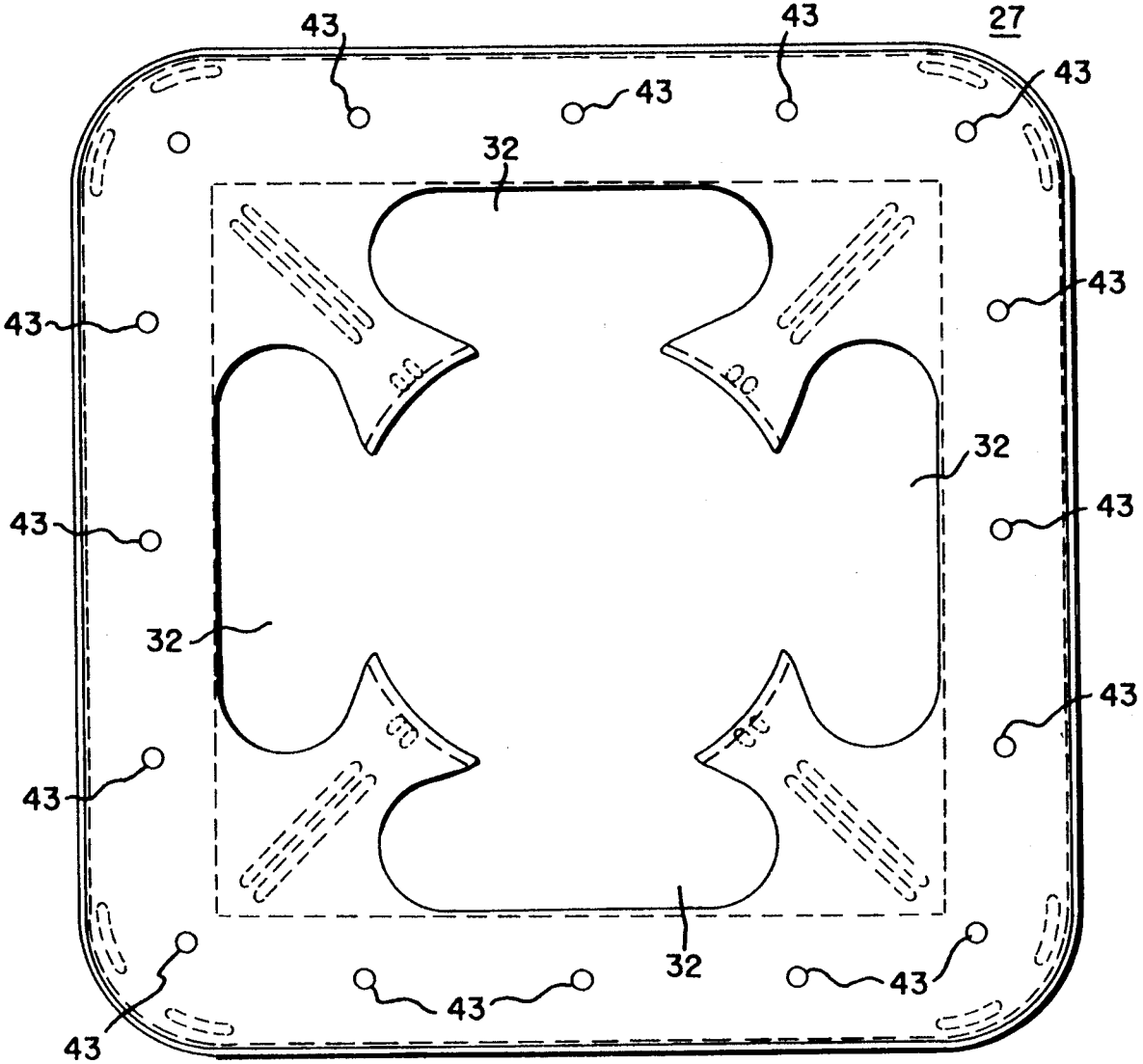
FIG. 5 is a top view of the face plate adaptable to the rear face of the pallet.
Figure 7:
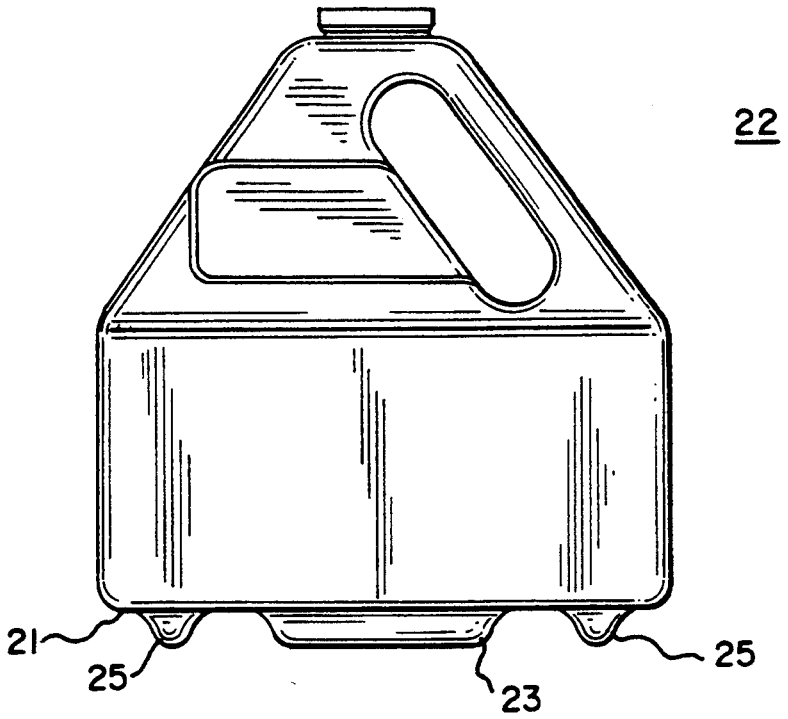
FIG. 7 is a perspective view of one container of the invention adapted to fit in the rear face of the pallet.
Figure 8:
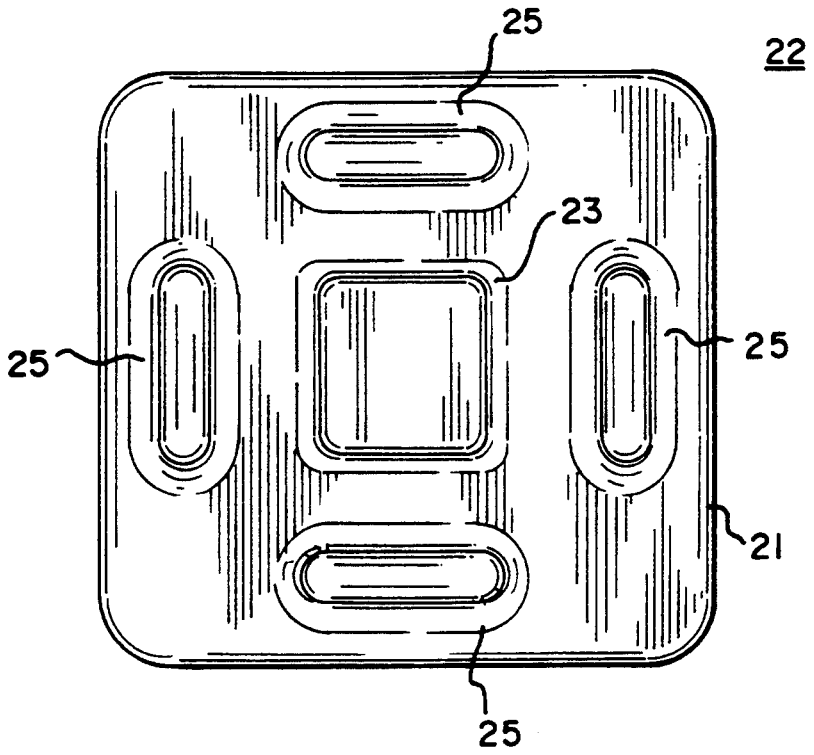
FIG. 8 is a bottom view of the container of FIG. 7.

Furthermore, pallet system 10 (FIG. 2) is shown having an arrangement of select sized containers 16, 18, 20, or 22 thereon (for illustrative purposes only). It should be appreciated that only one selected face 12 or 14 of pallet assembly 10 of the invention can be employed at any one time although, for illustration purposes, both faces 12, 14 are shown with containers thereon. In this arrangement, one of select container 16 or 18 is capturable in container receptacle comprising cavity 24 on rear face 12. Alternatively, in a reversed position, select container 20 or 22 is capturable in container receptacle of front face 14. Select container 22 adapted to fit into front face 14 of pallet 10 has a base 21 having central and peripheral protuberances 23, 25 extending downwardly therefrom, as shown in FIGS. 2, 7 and 8. Thus, central protuberance 23 of container 22 is insertable in cavity 30 of front face 14 while peripheral protuberances 25 are insertable in contoured openings 32 (FIG. 1). This arrangement, enables container 22 to interlockingly nest in the container receptacle of front face 14. As indicated hereinabove, pallet 10 has front face 14 having affixed thereto a face plate 27 (FIG. 5) having a plurality of contoured openings 32 adapted for receiving the peripheral protuberances 23 of select container 22. Face plate 27 is preferably attached to front face 14 with an adhesive material, such as polyvinyl chloride. Body member 11 and face plate 27 of pallet 10 are injection molded from ridged polyvinyl chloride. Although polyvinyl chloride is preferred because of its compatibility with the environment in which pallet 10 is used, practically any number of injection moldable plastics may be used, such as nylon, polycarbonate, etc. Face plate 27, which is permanently bonded in place, provides the conveyance and handling surface when select size 2 and 4 liter bottles are to be used.

In the photographic emulsion process, liquids are stored and transported in four sizes (½, 2, 4, and 10 liters), substantially corresponding to thin walled, blow molded, disposable containers 16, 18, 20, 22. The width of select containers 16, 18, 20, 22 may vary by about 0.125 inches (0.3175 cm) due to manufacturing tolerances and the weight and amount of solution within select container 16, 18, 20, 22. Each container receptacle 28 or 36 has a 0.50 inches (1.270 cm) radii on its lead-in edge 46 (shown in FIGS. 2 ) to aid in the automatic insertion of containers 16, 18, 20, 22 into pallet 10. Those skilled in the art will certainly appreciate that practically any size container can be adapted to the pallet system 10 of the invention.

Turning to FIGS. 9 and 10, compressible rubber inserts 48 are mounted on interior walls 13,15,17 (shown in FIGS. 1–4) to accommodate the dimensional variation of each container 16, 18, 20, 22. Preferably, inserts 48 are injection molded from 64A durometer thermoplastic rubber manufactured by P.T.A. Corp. of Ft. Collins, Colo., although those skilled in the art will appreciate that other materials may be used within the definition of the invention. Inserts 48 are pressed into slots 49 (FIG. 1) molded into body member 11 of pallet 10. Barb 50 (FIG. 9) molded onto the bottom of the insert 48 holds it in place in slot 49. In the preferred embodiment, each insert 48 has a plurality of ribs 52 (FIGS. 10 and 11) which engageably contacts a circumferential portion of containers 16, 18, 20, 22 when they are inserted into pallet 10. Ribs 52 compresses up to 0.080" which is sufficient to accommodate select container 16, 18, 20, 22 dimensional variation.

In operation, an array of pallets 10 (not shown) each having a select container 16, 18, 20, 22 captured by a container receptacle 28 or 36 is transported via a material handling system having robotic features. Pallet 10 is positioned on a conveyor, and a robot is used to extract the solution container, pour out the contents, and return the empty container to pallet 10. Pallets 10 securely hold a select container 16, 18, 20, 22 and provide the needed precision for the container's automatic removal and insertion.

In an alternative embodiment of the invention, pallet 10 has a plurality of recessed portions 54 (FIG. 6) in the exterior portion of sidewall 38 for receiving labels such as bar codes, date stamps, lot number, and the like. Sidewall 38 also comprises an opening 56 forming a pocket extending inwardly toward interior wall 40 for graspably handling pallet 10 when, for example, pallet 10 is removed or placed onto material handling equipment.

Accordingly, an important advantageous effect of the pallet system 10 of the invention is that it not only eliminates sliding characteristic of prior art pallets, it imparts a vertical force component to prevent tipping due to starting and stopping in an automatic system.

Another important advantage of the present invention is that the pallet system can easily handle one of four sizes of solution containers while interacting with automatic handling equipment.

The invention has therefore been described in detail with particular reference to preferred embodiments thereof, but it will be understood that variations and modifications can be effected within the spirit and scope of the invention.

Having described our invention in sufficient detail to enable those skilled in the art to make and use it, we claim and desire to secure Letters Patent of the United States for:

1. A pallet assembly for transporting and storing one of a select sized container, said pallet assembly comprising:

a body member having a first face and a second face;

said first face having at least one first cavity having a plurality of substantially concentric upstanding sidewalls defining a first container receptacle, said first container receptacle having a base common to said sidewalls extending upwardly into said first cavity;

said second face having at least one second cavity and means cooperatively associated with said second cavity on at least one side of said second cavity defining a second container receptacle and wherein said base extending upwardly in said first container receptacle extends inwardly of said second container receptacle;

whereby said first container receptacle or said second container receptacle can be used to transport and store one of a select sized container.

2. The pallet assembly recited in claim 1 further comprising at least one retaining means mounted on interior walls of said container receptacle for securely holding said select sized container.

3. The pallet assembly recited in claim 1 wherein said body member is substantially a parallelapiped.

4. The pallet assembly recited in claim 1 wherein said body member further comprises means for draining said pallet.

5. The pallet assembly recited in claim 1 wherein said body member comprises means for graspably handling said pallet.

6. The pallet assembly recited in claim 1 wherein said body member comprises means for displaying bar coded information.

7. A pallet assembly with a container thereon, one said container having a length, width and a base with central and peripheral protuberances extending outwardly from said base, said pallet assembly comprising:

a) a body having opposed front and rear faces and upstanding sidewalls supportably surrounding said front and rear faces;

b) said upstanding sidewalls comprising spaced apart, substantially parallel inner and outer wall members and a plurality of support members structurally interconnecting said inner and outer wall members;

c) said front face having at least one cavity having a base extending upwardly into said cavity, said cavity defining a first container receptacle, said cavity having a width and length substantially equal to said width and length of said container;

d) said rear face having at least one substantially rectangular central cavity having a base, wherein said base extending upwardly into said cavity of said front face extends inwardly of said cavity in said rear face for receiving said central protuberance of said base of said container, said cavity having a width and length substantially equal to said central protuberance of said container and a depth substantially equal to said height of said central protuberance of said container so that said central protuberance of said container fits snugly in said cavity;

e) a face plate attachable to said rear face, said face plate having a plurality of contoured openings cooperatively associated with said central cavity of said rear face to define at least a second container receptacle, said contoured openings configured to receive said peripheral protuberances of said base of said container;

f) means projecting outwardly in each said container receptacles in said front and rear faces for engageably retaining a circumferential portion of said container;

g) at least one throughhole defining a pocket in said outer wall member of said sidewall for graspably engaging said pallet; and, h) a plurality of recesses on said outer wall of said sidewall for receiving and displaying bar code information.

8. The pallet assembly with container thereon recited in claim 7 wherein said face plate and said rear face are attached with an adhesive material.

9. The pallet assembly with container thereon recited in claim 7 wherein the body portion is a made of a thermoformable material.

10. The pallet assembly with container thereon recited in claim 7 wherein said thermoformable material is polyvinyl chloride.

11. The pallet assembly with container thereon recited in claim 7 wherein said central protuberance of one said container comprises recess portions for snugly engaging said means projecting outwardly in said container receptacle.

12. The pallet assembly with container thereon recited in claim 7 wherein said front and rear faces each has a plurality of througholes for draining solution therefrom.

13. A pallet assembly having a container of a select size container thereon, one said container having a length, width and a base with central and peripheral protuberances extending outwardly from side base, said pallet assembly comprising:

a) a body having opposed front and rear faces and upstanding sidewalls supportably surrounding said front and rear faces;

b) said upstanding sidewalls comprising spaced apart, substantially parallel inner and outer wall members and a plurality of support members structurally interconnecting said inner and outer wall members;

c) said front face having a plurality of substantially concentric cavities having a common base extending upwardly into said cavities, each cavity defining a sized container receptacle, each said cavity having an interior wall having a width and length substantially equal to said width and length of said sized container receptacle, each interior wall further having spaced apart slots;

d) said rear face having at least one substantially rectangular central cavity having a base, wherein said base extending upwardly into said cavities of said front face extends inwardly of said cavities in said rear face for receiving said central protuberance of said base of said sized container, said cavity having an interior wall having a width and length substantially equal to said central protuberance of said sized container and a depth substantially equal to said height of said central protuberance of said sized container so that said central protuberance of said sized container fits snugly in said cavity, said interior wall further having a plurality of spaced apart slots;

e) a face plate attachable to said rear face, said face plate having a plurality of contoured openings cooperatively associated with said central cavity of said rear face to define a sized container receptacle, said openings configured to receive said peripheral protuberance of said base of said sized container;

f) a plurality of resilient inserts, each insert being slidably disposed in one said slot in said interior walls, said inserts projecting outwardly in each said container receptacle for engageably retaining a circumferential portion of said sized container;

g) at least one throughhole defining a pocket in said outer wall member of said sidewall for graspably engaging said pallet; and, h) a plurality of recesses on said outer wall of said sidewall for receiving and displaying bar code information.

14. The pallet assembly recited in claim 13 wherein said face plate and said rear face are attached with an adhesive material.

15. The pallet assembly recited in claim 13 wherein said adhesive material is polyvinyl chloride.

16. The pallet assembly recited in claim 13 wherein said inserts are made of a thermoplastic rubber material.

17. The pallet assembly recited in claim 13 wherein said inserts have a plurality of compressible ribs for engaging the circumferential portion of said container.

* * * * *